US008347668B2

(12) United States Patent
Min

(10) Patent No.: US 8,347,668 B2
(45) Date of Patent: Jan. 8, 2013

(54) DIFFERENTIAL LINKAGE ATTACHMENT OF DOOR HANDLES

(76) Inventor: Yu Min, Guangdong (CN)

( * ) Notice: Subject to any disclaimer, the term of this patent is extended or adjusted under 35 U.S.C. 154(b) by 15 days.

(21) Appl. No.: 13/117,502

(22) Filed: May 27, 2011

(65) Prior Publication Data

US 2011/0226024 A1 Sep. 22, 2011

Related U.S. Application Data

(63) Continuation-in-part of application No. PCT/CN2009/075046, filed on Nov. 20, 2009.

(30) Foreign Application Priority Data

Dec. 3, 2008 (CN) ..... 2008 2 0214254 U

(51) Int. Cl.
*E05B 59/00* (2006.01)
*E05B 63/14* (2006.01)

(52) U.S. Cl. ..... 70/107; 70/149; 70/380; 292/34; 292/165; 292/336.5

(58) Field of Classification Search ..... 70/107, 70/379 R, 379 A, 380, 381, 108–111, 141, 70/143, 144, 149, 150, 157; 292/34, 36, 292/39, 40, 165, 336.3, 336.5
See application file for complete search history.

(56) References Cited

U.S. PATENT DOCUMENTS

| | | | | |
|---|---|---|---|---|
| 6,526,787 | B2 * | 3/2003 | Ming-Chih | 70/107 |
| 6,578,888 | B1 * | 6/2003 | Fayngersh et al. | 70/107 |
| 6,928,844 | B2 * | 8/2005 | Chiang et al. | 70/107 |
| 6,993,946 | B1 * | 2/2006 | Shen | 70/107 |
| 7,003,990 | B2 * | 2/2006 | Iliuk | 70/107 |
| 7,353,674 | B2 * | 4/2008 | Raatikainen et al. | 70/107 |
| 2002/0166352 | A1 * | 11/2002 | Ming-Chih | 70/107 |
| 2003/0033839 | A1 | 2/2003 | Chen | |
| 2005/0103066 | A1 * | 5/2005 | Botha et al. | 70/107 |

FOREIGN PATENT DOCUMENTS

| | | |
|---|---|---|
| CN | 2308684 | 2/1999 |
| CN | 2416191 | 1/2001 |
| CN | 2634048 | 8/2004 |
| CN | 2883591 | 3/2007 |
| CN | 201137331 | 10/2008 |

* cited by examiner

*Primary Examiner* — Christopher Boswell
(74) *Attorney, Agent, or Firm* — Jacobson Holman PLLC

(57) ABSTRACT

A differential linkage attachment of handles includes a first handle ring and a second handle ring placed on right and left sides, respectively, and set in a rectangular dead bolt shifting block independently. An end of the second handle ring is encircled with a first slanted latch bolt shifting plate, and an end of the first handle ring is encircled with a second slanted latch bolt shifting plate. All of the five parts turn around on a center axis. When the second handle ring turns forward or clockwise, the rectangular dead bolt shifting block or the first slanted latch bolt shifting plate is linked to turn around on the center axis independently, and when the first handle ring turns clockwise, the rectangular dead bolt shifting block or the second slanted latch bolt shifting plate is linked to turn around on the center axis independently. When the second handle ring or the first handle ring turns backward or counter-clockwise, only the rectangular dead bolt shifting block is linked, so that the rectangular dead bolt extends out to lock the door. Front and rear handles operate the rectangular dead bolt and the slanted latch bolt independently.

1 Claim, 6 Drawing Sheets

DIFFERENTIAL LINKAGE ATTACHMENT OF DOOR HANDLES

This application is a continuation-in-part of PCT/CN09/075046, filed Nov. 20, 2009, which has a priority of Chinese Application No. 2008202142543, filed Dec. 3, 2008, hereby incorporated in its entirety by reference.

FIELD OF THE INVENTION

The present invention involves a part for locks, in particular a mechanism for a differential linkage attachment of handles of a dead bolt assembly.

BACKGROUND OF THE INVENTION

Currently, few mechanisms of differential linkage attachment of handles in the market can realize front and back handles that independently operate a rectangular dead bolt and a slanted latch bolt.

SUMMARY OF THE INVENTION

The present invention provides a differential linkage attachment of handles for a new type of lock. It has a simple structure, is stable and provides reliable performance, and is easy to produce at low cost. These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

Figure 1:
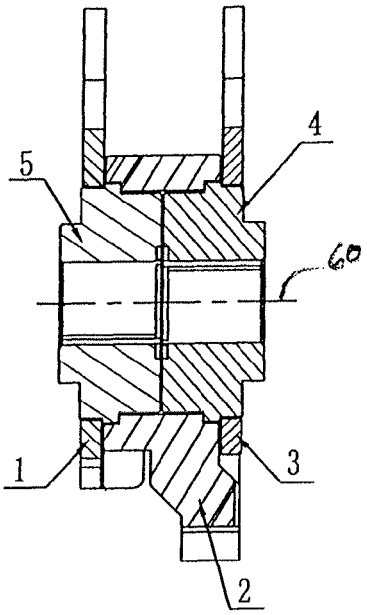
FIG. 1 is a schematic diagram of the present invention.

In the figures: 1. Slanted latch bolt shifting plate; 2. Rectangular dead bolt shifting block; 3. Slanted latch bolt shifting plate; 4. First handle ring; and 5. Second handle ring.

DETAILED DESCRIPTION OF THE PREFERRED EMBODIMENTS

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

A differential linkage attachment of inside and outside door handles of the present invention includes a slanted latch bolt shifting plate 1, a rectangular dead bolt shifting block 2, a slanted latch bolt shifting plate 3, a rotatable handle ring 4 and a rotatable handle ring 5. The handle ring 4 and the handle ring 5 are placed on right and left sides, respectively, on an inner side and an outer side of a dead bolt locking mechanism, and set independently in the rectangular dead bolt shifting block 2. A convex round end of the handle ring 5 is encircled within the slanted latch bolt shifting plate 1, and a top of an end of the handle ring 4 is encircled within the slanted latch bolt shifting plate 3. The five parts (1, 2, 3, 4 and 5) pivot around a center axis 60.

The handle ring 5 is rotatable in a circular sector direction. When the handle ring 5 moves forward (clockwise), the rectangular dead bolt shifting block 2 or the slanted latch bolt shifting plate 1 independently turns around on center axis 60. When the handle ring 5 moves backward (counter clockwise), only the rectangular dead bolt shifting block 2 is linked, so that the rectangular dead bolt 6 is engaged to move out of a faceplate of the locking mechanism to lock a door.

The handle ring 4 is rotatable in a circular sector direction. When the handle ring 4 moves forward (clockwise), the rectangular dead bolt shifting block 2 or the slanted latch bolt shifting plate 3 independently turns around on center axis 60. When the handle ring 4 moves backward (counter clockwise), only the rectangular dead bolt shifting block 2 is linked, so that the rectangular bolt 6 is engaged to move out of the faceplate of the locking mechanism to lock the door.

I. Description of Movement

Figure 5:
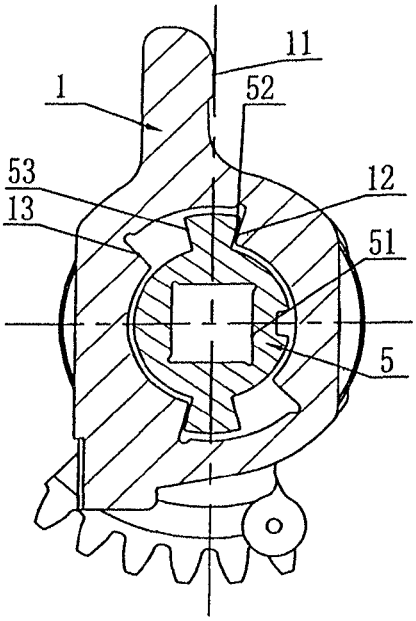
FIG. 5 is a sectional view taken along line 5-5 of FIG. 6.
Figure 6:
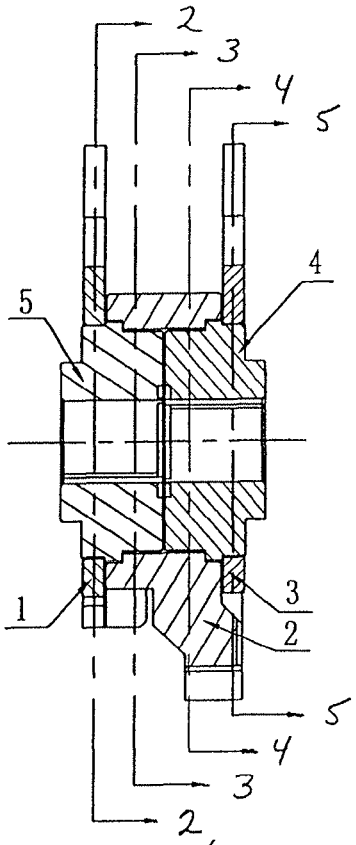
FIG. 6 is a schematic diagram of the present invention.
Figure 9:
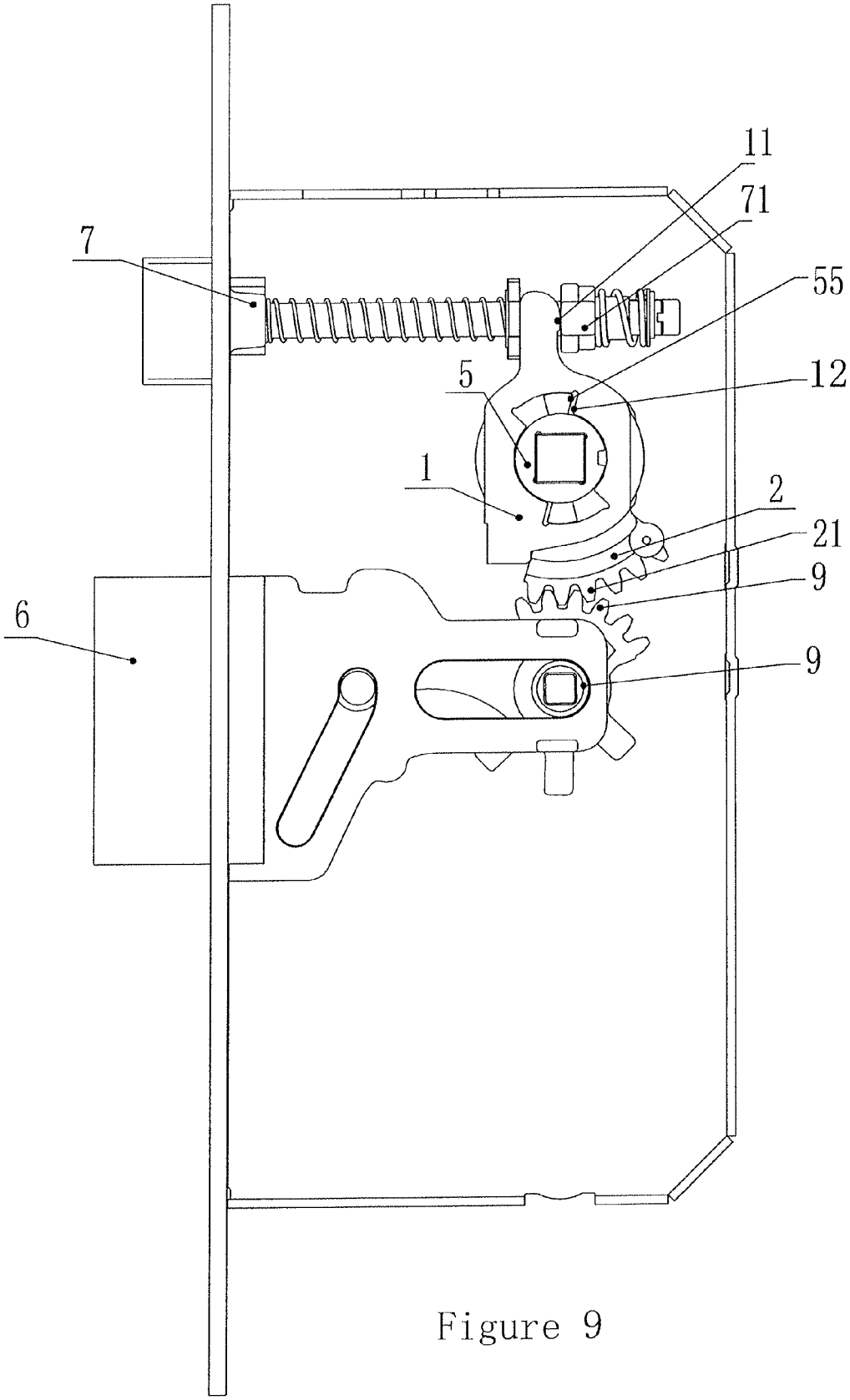
FIG. 9 is a schematic diagram of the linkage of FIG. 5, shown in a dead bolt and latch bolt assembly.
Figure 10:
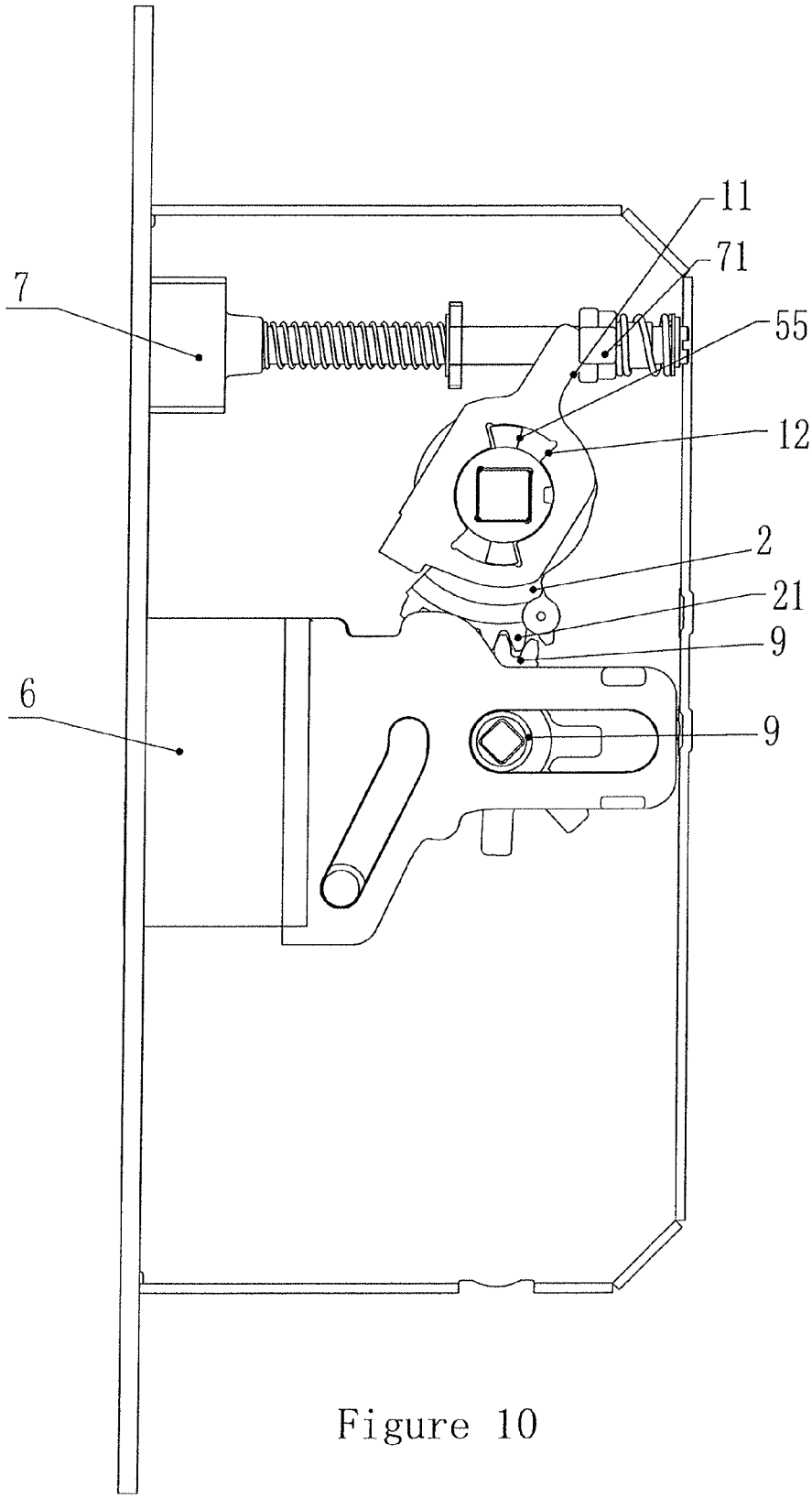
FIG. 10 is a schematic diagram of the assembly shown in FIG. 9, turned 90° by operation of a handle (not shown).

As shown in FIGS. 5, 9 and 10, a central axial hole 51 is provided on the handle ring 5 and links the handle ring 5 with the front handle or the back handle of a door so that the handle ring 5 and the front handle or the back handle of the door can turn around together with the slanted latch bolt shifting plate 1 linked to turn around on center axis 60. A pulling arm 11 is provided on the slanted latch bolt shifting plate 1. When the pulling arm 11 moves forward (clockwise) as shown in FIG. 10, a driving mechanism 71 of the slanted latch bolt is independently linked.

Figure 3:
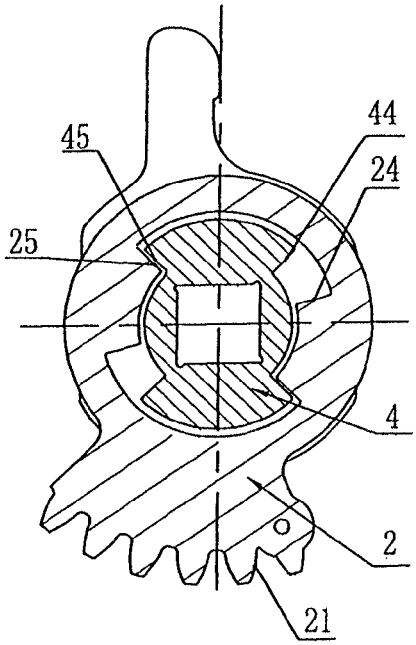
FIG. 3 is a sectional view taken along line 3-3 of FIG. 6.

As shown in FIGS. 3, 9 and 10, a gear 21 is provided on the rectangular dead bolt shifting block 2. When the gear 21 moves, the rectangular dead bolt shifting block 9 is linked. Meanwhile, rectangular dead bolt 6 is also linked to block 9 so that the driving mechanism 71 of the slanted latch bolt 7 can be independently linked to the block 9.

Figure 2:
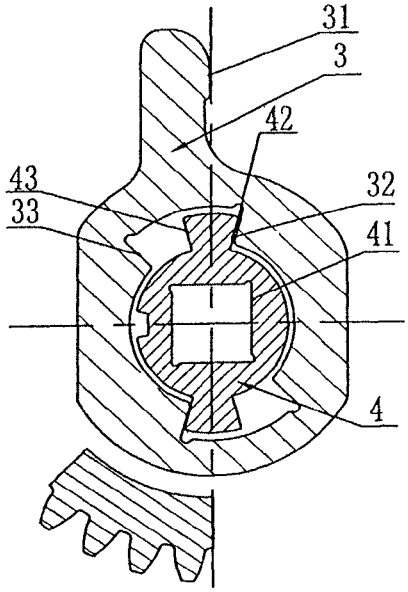
FIG. 2 is a sectional view taken along line 2-2 of FIG. 6.

As shown in FIG. 2, a central axial hole 41 is provided on the handle ring 4 and links the handle ring 4 with the front handle or the back handle of the door to turn the handle ring 4 with the front handle or the back handle together with the slanted latch bolt shifting plate 3 linked to turn around on a center axis 60. A pulling arm 31 is provided on the slanted latch bolt shifting plate 3. When the pulling arm 31 moves forward (clockwise), the driving mechanism 71 of the slanted latch bolt shifting plate 3 can be independently linked.

After the handle ring 5 is linked with one of the front handle or the back handle of the door to rotate together, the central axial hole 41 can link the handle ring 4 with the other of the front or rear handle, to turn around together.

II. Description of Differential Linkage

As shown in FIGS. 5, 9 and 10, a sector stop edge 12 and a sector stop edge 13 are provided on the slanted latch bolt shifting plate 1. A sector convex block 52 and a sector convex block 53 are provided on the handle ring 5 and are set in the sector space formed between the stop edge 12 and the stop edge 13. When a door handle is turned and the convex block 52 engages the stop edge 12 and the handle ring 5 is moved forward (clockwise), the slanted latch bolt shifting plate 1 is linked to turn together with the handle ring 5. Meanwhile, a slider of driving mechanism 71 is linked by pulling arm 11 so that the slanted latch bolt 7 is linked and retracted as shown in FIG. 10.

When the handle ring 5 moves backward (counter clockwise), the slanted latch bolt shifting plate 1 is not linked, so also the slanted latch bolt 7 cannot be linked because of the space between the convex block 53 and the stop edge 13 (that is, the slanted latch bolt is biased by a spring of the driving mechanism 71 into extension).

Figure 4:
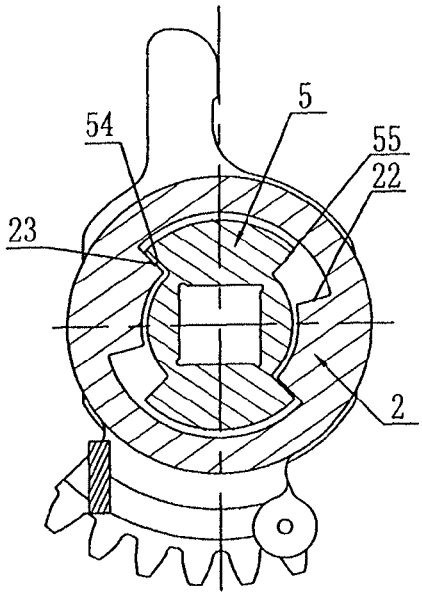
FIG. 4 is a sectional view taken along line 4-4 of FIG. 6.
Figure 12:
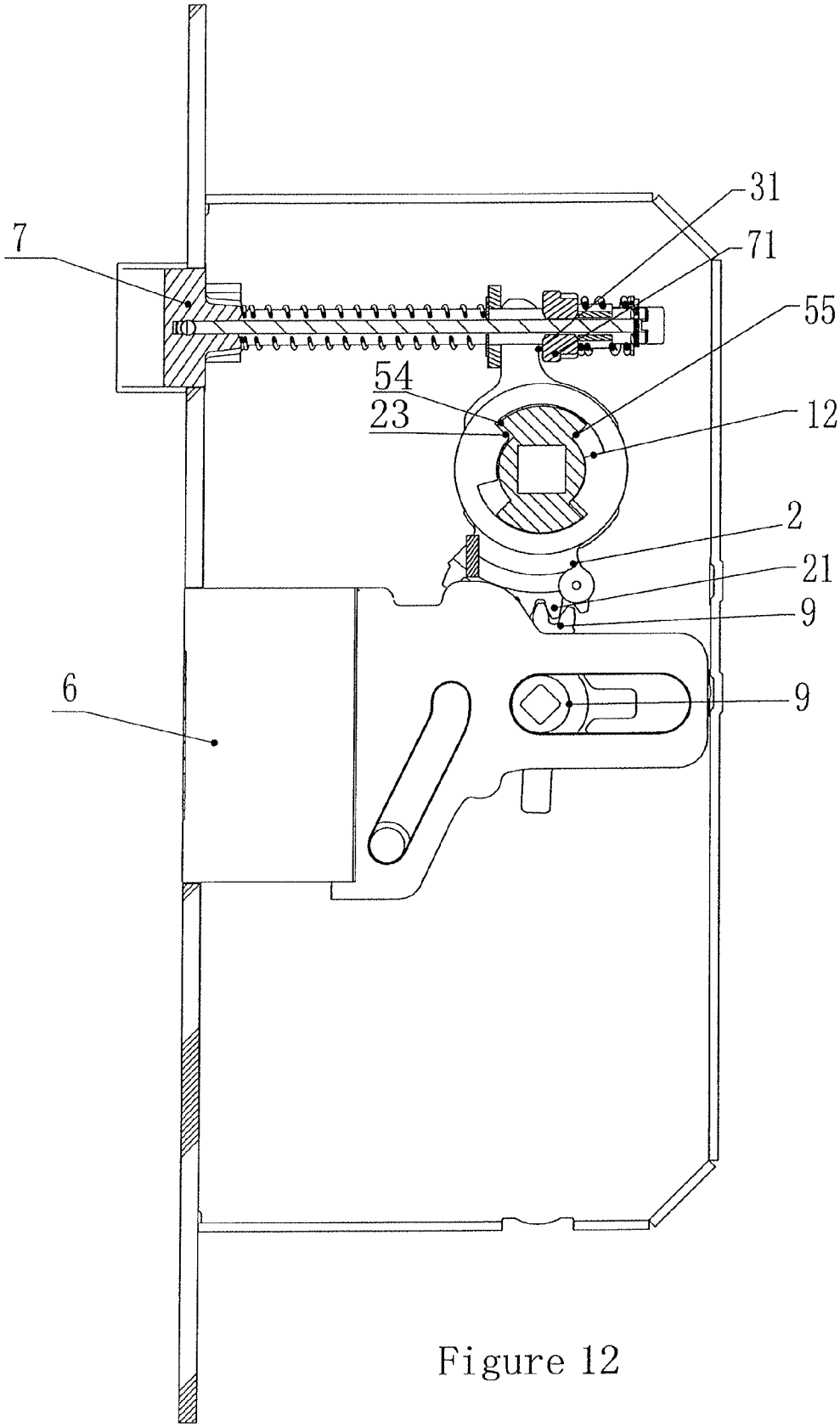
FIG. 12 is a schematic diagram of the linkage of FIG. 3, shown in a dead bolt and latch bolt assembly.

As shown in FIGS. 4 and 12, the rectangular dead bolt 6 is in the state of being retracted to open the door. A sector stop edge 22 and a sector stop edge 23 are provided on the rectangular dead bolt shifting block 2. A sector convex block 54 and a sector convex block 55 are provided on the handle ring 5 and are set in the sector space formed between the stop edge 22 and the sector stop edge 23.

When the handle ring 5 moves forward (clockwise), the rectangular dead bolt shifting block 2 is not linked to retract the rectangular dead bolt 6 to open the door (that is, the slanted latch bolt 7 is in the state of retracting to open the door), because of the space between the convex block 55 and the stop edge 22. When the convex block 54 contacts the stop edge 23 and the handle ring 5 continues to move backward (counter clockwise), the rectangular dead bolt shifting block 2 will move backward (counter clockwise). When the gear 21 of the rectangular dead bolt shifting block 2 moves, the rectangular dead bolt shifting block 9 is linked. Meanwhile, rectangular dead bolt 6 is linked too so that the rectangular dead bolt 6 is engaged to lock the door.

Figure 7:
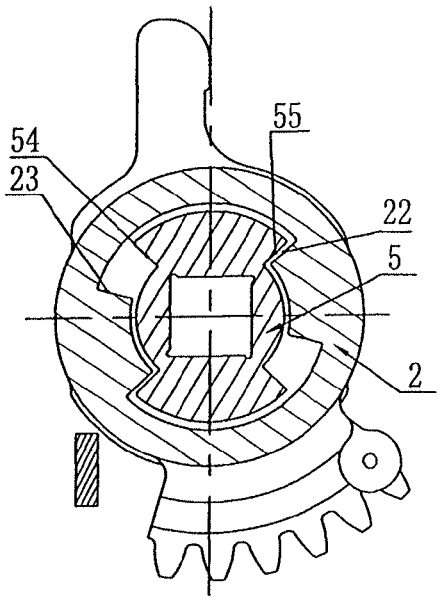
FIG. 7 illustrates a positioning of FIG. 4, after movement.
Figure 11:
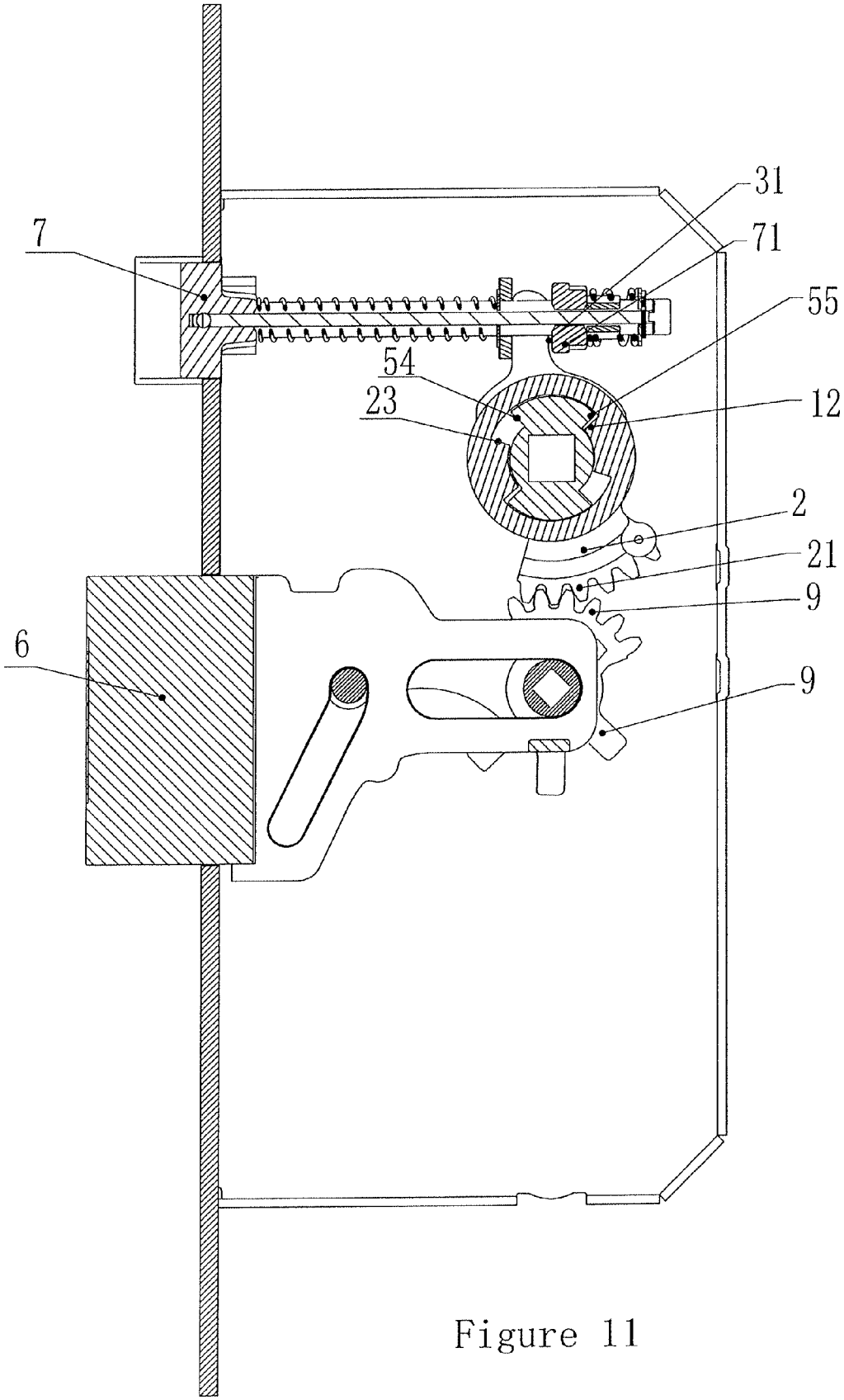
FIG. 11 is a schematic diagram of the linkage of FIG. 7, shown in a dead bolt and latch bolt assembly.

As shown in FIGS. 7 and 11, the rectangular dead bolt 6 is engaged to lock the door. When the convex block 55 contacts the stop edge 22 and the handle ring 5 continues to move forward (clockwise), the rectangular dead bolt shifting block 2 moves backward (counter clockwise). When the gear 21 of the rectangular dead bolt shifting block 2 moves, the rectangular dead bolt shifting block 9 is linked. Meanwhile, rectangular dead bolt 6 is linked too so that the rectangular dead bolt 6 is retracted to open the door.

When the handle ring 5 moves backward (counter clockwise), the rectangular dead bolt shifting block 2 is not linked because of the space between the convex block 54 and the stop edge 23. The rectangular dead bolt shifting block 9 and rectangular dead bolt 6 are not linked so the rectangular dead bolt 6 remains extended to lock the door.

As shown in FIGS. 2 and 11, a sector stop edge 32 and a sector stop edge 33 are provided on the slanted latch bolt shifting plate 3. A sector convex block 42 and a sector convex block 43 are provided on the handle ring 4 and are set in the sector space formed between the stop edge 32 and the stop edge 33. When the stop edge 32 contacts the convex block 42 and the handle ring 4 continues to move forward (clockwise), the slanted latch bolt shifting plate 3 is linked to turn around forward (clockwise) together with the handle ring 4. Meanwhile, the slider of the driving mechanism 71 is linked by pulling arm 31 so that the slanted latch bolt 7 is linked and triggered.

When the handle ring 4 moves backward (counter clockwise), the slanted latch bolt shifting plate 3 cannot be linked, so that the slanted latch bolt 7 cannot be linked by pulling arm 31 because of the space between the stop edge 33 and the convex block 43. So, when the handle ring 4 moves backward (counter clockwise), it will not make the slanted latch bolt 7 move.

As shown in FIGS. 3 and 12, the rectangular dead bolt 6 is in the state of retracting to open the door. A sector stop edge 24 and a sector stop edge 25 are provided on the rectangular dead bolt shifting block 2. A sector convex block 44 and a sector convex block 45 are provided on the handle ring 4 and are set in the sector space formed between the stop edge 24 and the sector stop edge 25. When the handle ring 4 moves forward (clockwise), the rectangular dead bolt shifting block 2 cannot be linked to retract to open the door (that is, to allow the slanted latch bolt into the state of retracting to open the door), because of the space between the convex block 44 and the stop edge 24. When the convex block 45 contacts the stop edge 25 and the handle ring 4 continues to move backward (counter clockwise), the rectangular dead bolt shifting block 2 is linked together so when the handle ring 4 moves backwardly (counter clockwise), the handle ring 4 will make the rectangular dead bolt 6 lock the door.

Figure 8:
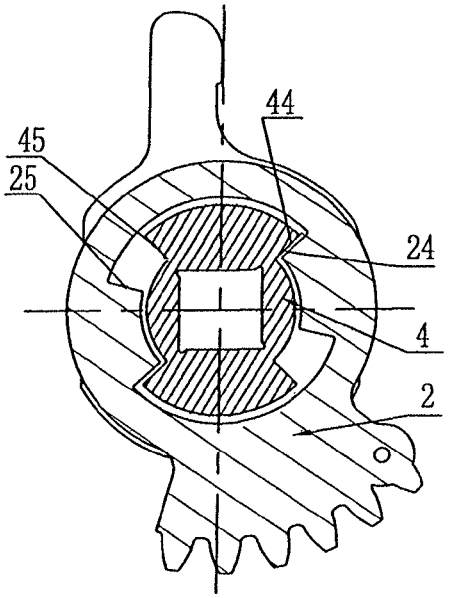
FIG. 8 illustrates a position of FIG. 3, after movement.

As shown in FIGS. 8 and 11, the rectangular dead bolt 6 is engaged to lock the door. When the convex block 44 contacts the stop edge 24 and the handle ring 4 continues to move forward (clockwise), the handle ring 4 will make the rectangular dead bolt shifting block 2 move forward (clockwise). When the gear 21 of the rectangular dead bolt shifting block 2 moves, the rectangular dead bolt shifting block 9 is linked. Meanwhile, rectangular dead bolt 6 is linked too, so that the rectangular dead bolt 6 is retracted to open the door. When the handle ring 4 moves backward (counter clockwise), the rectangular dead bolt shifting block 2 cannot be linked with handle ring 4 because of the space between the convex block 45 and the stop edge 25. When the handle ring moves backward (counter clockwise), it will not retract the rectangular dead bolt 6 to unlock the door.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A differential linkage attachment for handles of a door, the differential linkage attachment comprising a latch bolt biased by a biased driving mechanism to extend out of a door, a dead bolt having a cam slot, a first latch bolt shifting plate, a dead bolt shifting block cooperating with the cam slot of the dead bolt to move the dead bolt in and out, a second latch bolt shifting plate, a first handle ring, and a second handle ring, the first handle ring and the second handle ring being independently set to cooperate with the dead bolt shifting block, a sector convex end of the second handle ring being encircled by and rotatable between opposite ends of a passageway defined in the first latch bolt shifting plate and a sector convex end of the first handle ring being encircled by and rotatable between opposite ends of a passageway defined in the second latch bolt shifting plate, a pulling arm of the first latch bolt shifting plate and a pulling arm of the second latch bolt shifting plate engaging the biased driving mechanism of the latch bolt to retract the latch bolt upon movement of one of the first latch bolt shifting plate and the second latch bolt shifting plate, the first latch bolt shifting plate, the second latch bolt shifting plate, the dead bolt shifting block, the first handle ring and the second handle ring all being rotatable around a common center axis, wherein when the second handle ring moves forward, one of the dead bolt shifting block and the first latch bolt shifting plate is linked to turn around on the center axis, and when the second handle ring moves backward, only the dead bolt shifting block is linked so that the dead bolt extends out to lock the door, and when the first handle ring moves forward, one of the dead bolt shifting block and the second slant bolt shifting plate is linked to turn around on the center axis, and when the first handle ring moves backward, only the dead bolt shifting block is linked so that the dead bolt extends out to lock the door.

* * * * *